US005497739A

United States Patent [19]

Müller

[11] Patent Number: 5,497,739

[45] Date of Patent: Mar. 12, 1996

[54] KICK STARTING MEANS

[76] Inventor: Werner Müller, Ehekirchener Strasse 16, 86669 Klingsmoos, Germany

[21] Appl. No.: 268,768

[22] Filed: Jun. 29, 1994

[30] Foreign Application Priority Data

Jul. 1, 1993 [DE] Germany ..... 43 21 993.4

[51] Int. Cl.[6] ..... F02N 3/04

[52] U.S. Cl. ..... 123/185.6; 74/7 C

[58] Field of Search ..... 123/185.5, 185.6; 74/7 C, 6

[56] References Cited

U.S. PATENT DOCUMENTS

| | | | |
|---|---|---|---|
| 1,268,501 | 6/1918 | Schwin | 74/6 |
| 4,744,257 | 5/1988 | Yagasaki et al. | 123/185.6 |
| 5,233,952 | 8/1993 | Isaka | 123/179.17 |

FOREIGN PATENT DOCUMENTS

| | | | |
|---|---|---|---|
| 4124072A1 | 2/1992 | Germany . | |
| 55-75567 | 6/1980 | Japan | 123/185.5 |

OTHER PUBLICATIONS

Catalog: Chrome Specialties Inc., Arlington, Texas, copyright 1992, p. 373.

Catalog: TOM'S International Motorcycle Products GmbH, Germany, copyright 1993, p. 11.

Catalog: Custom Chrome Inc., U.S.A., copyright 1991, p. 281.

Catalog: Chrome Specialties Inc., Arlington, Texas, copyright 1992, p. 240.

*Primary Examiner*—Andrew M. Dolinar

*Attorney, Agent, or Firm*—Westman, Champlin & Kelly

[57] ABSTRACT

The invention relates to a kick starting means for change gears, in particular for retrofitting motorcycles of the company Harley-Davidson, U.S.A., with the name "Big Twin", a cubic capacity of about 1340 $cm^3$ and a five-speed change gear, which has been built since 1980. A kick starting axis 1 is located outside of a gear shaft level 2 formed by a gear drive axle 3 and a gear driven axle 4. This arrangement makes it possible that for retrofitting the aforementioned motorcycles with kick starting means, no modification of the original exhaust pipe assembly is necessary. (FIG. 2 )

10 Claims, 2 Drawing Sheets

KICK STARTING MEANS

The invention relates to a kick starting means for change gears, in particular for retrofitting motorcycles. This especially relates to motorcycles in which a kick starting means with a kick starting axis on a gear shaft level would make it necessary to modify other elements, as for example the exhaust pipe assembly. Such motorcycles are, for example, supplied by the company Harley-Davidson, U.S.A., with a cubic capacity of about 1340 $cm^3$ (so-called "Big Twin"-motorcycles) and a five-speed change gear, which has been built since 1980. The present invention allows the removal of the kick starting axis from the gear shaft level formed by a change gear drive axle and driven axle.

In the state of the art, larger motorcycles, especially the above-mentioned models, are merely designed and equipped with an electric starter motor without a kick starter. However, in view of the advantages of a kick starting means however, e.g. the availability of an additional starting support, or for nostalgic reasons, especially in the case of classic traditional motorcycles as the ones supplied by the company Harley-Davidson, consumers have once again expressed the wish for kick starting means.

However, since the above-described motorcycles were conceived without kick starting means, attempts were made to offer kick starting means for these models for mounting at a later date on the existing gear unit without any further modifications. However, these attempts were futile. A number of suppliers put kick starting means for mounting on the change gear connection of the gear unit on the market which were adjusted to the above-mentioned models (cf. for example catalog of the company Chrome Specialities, Inc., Arlington, Tex., U.S.A., 1992, p. 373; catalog of the company TOM'S International Motorcycle Products GmbH, Germany, 1993, Part 11). Since especially the mufflers of the exhaust pipe assembly are located next to the change gear connection onto which the offered kick starting means are supposed to be mounted, considerable modifications of the exhaust pipe assembly in order to adapt it to the offered kick starting means have been necessary. For this purpose, e.g. the exhaust manifold had to be lengthened and the mufflers had to moved back or else their design had to be altered considerably.

In order to avoid these considerable disadvantages and especially in order to fulfill the nostalgic expectations of the consumers, even imitations of kickstarting means to be mounted onto the change gear connection which do not interfere with the exhaust manifolds are offered, however, they do not have any practical function. (cf. catalog of the company Custom Chrome, Inc., U.S.A., 1991, p. 281).

It is the object of the present invention to overcome the above-mentioned disadvantages of the prior art and to provide a functioning kick starting means which, above all, does not require any modification of external elements, as for example an exhaust pipe assembly, of the mentioned motorcycles.

At the time when the above-mentioned motorcycles still comprised a kick starting means as standard equipment, the axes of those kick starting means were always located in a gear shaft level formed by a gear drive axle and driven axle. This arrangement was adopted by all of the aforementioned suppliers of kick starting means.

Surprisingly, by means of kick starting means according to the present invention it is now possible that no external elements have to be modified and that the original appearance of the above-mentioned motorcycles is maintained. For this purpose, in the case of the kick starting means of the present invention the kick starting axis is located outside of the gear shaft level, in case of the above-mentioned models above the gear shaft level.

The object, advantages and features of the invention are now described in more detail by means of examples and with reference to the drawings.

FIG. 1 shows schematically the gear shaft level 2 of the above-mentioned motorcycles, as for example of the Harley-Davidson series "Big Twin" with a cubic capacity of about 1340 $cm^3$ and a five-speed change gear, which has been built since 1980 by the company Harley-Davidson.

Figure 1:
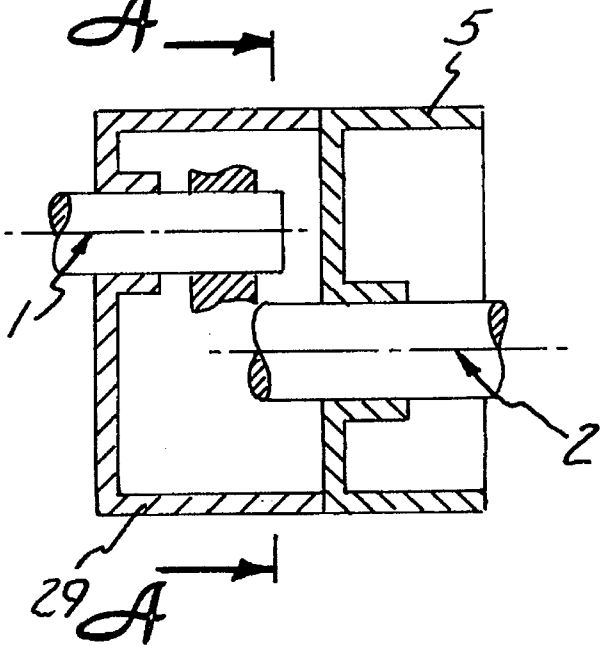
FIG. 1 shows a longitudinal section showing the concept of the kick starting means according to the present invention.

A drive shaft and a driven axle which form the gear shaft level 2 are accessible on the change gear connection 5. According to the invention, a cover 29 can be attached to the change gear connection. On the outside of the cover 29 a known lever (not shown in the drawing) for moving the kick starting means is mounted stationary on a kick starting axis 1. The kick starting axis 1 is located above the gear shaft level 2 in such a way that the lever does not interfere with the original configuration of the external elements (not shown in FIG. 1) as e.g. the exhaust pipe assembly during operation.

Figure 2:
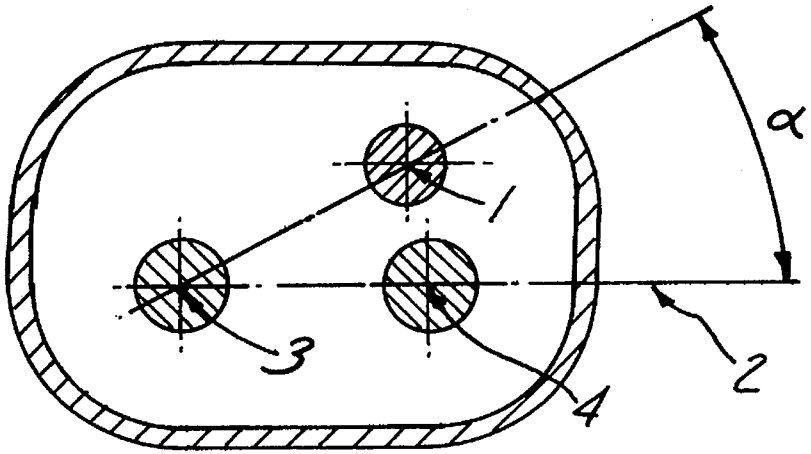
FIG. 2 shows a section along A—A in FIG. 1.

FIG. 2 shows the position of the gear drive axle 3 and the driven axle 4 which both lie in the gear shaft level 2. The kick starting axis 1 of the kick starting means according to the present invention is furthermore positioned in the gear shaft level relative to the shafts 3 and 4 in such a way that the elements of the kick starting means on the kick starting axis 1 which are located within the cover 29 can be in mesh with the elements on the gear drive axle 3 without hindering the rotary movement of the gear driven axle 4.

In a preferred embodiment of the present invention, the gear shaft level 2 and an imaginary level between the kick starting axis 1 and the gear drive axle 3 form an angle $\alpha$ of about 10° to 90°. In a further preferred embodiment, the angle $\alpha$ is between 20° and 50° and most preferably between 25° and 35°.

Figure 3:
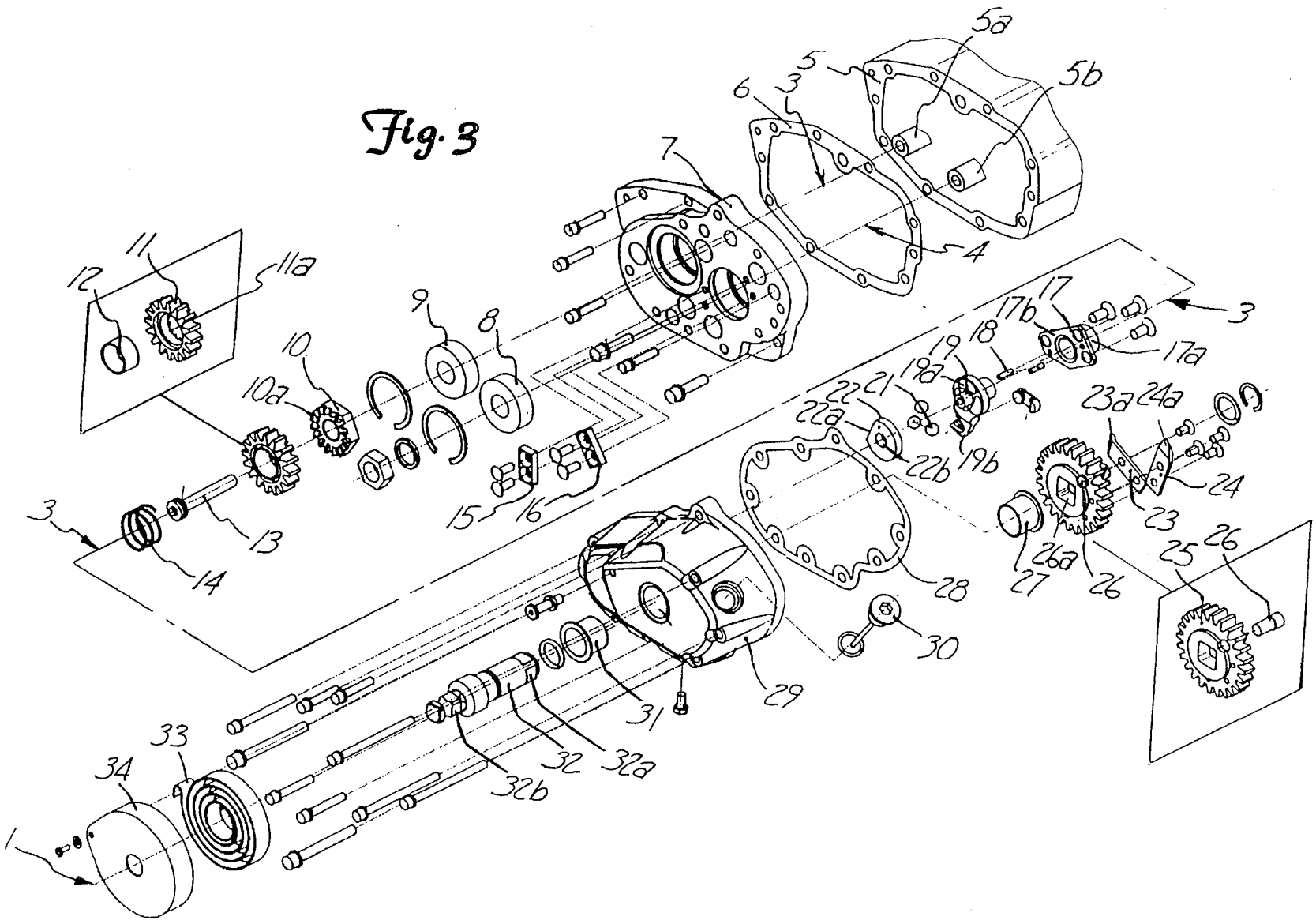
FIG. 3 shows an exploded view of the kick starting means of in a preferred embodiment of the invention.

FIG. 3, which shows a preferred embodiment of the kick starting means of the present invention, shows the change gear connection 5 of a motorcycle with shaft guides **5*a* and 5*b* for the corresponding gear shafts on the gear drive axle 3 and the gear driven axle 4. An intermediary plate 7 on the change gear connection 5 and a seal 6 between the intermediary plate 7 and the change gear connection 5 can be attached rigidly, e.g. by means of suitable pan head screws. Corresponding shaft bearings 8 and 9 are fixed, e.g. by means of circlips, in bores which are in alignment with the gear drive axle 3 and the gear driven axle 4. Furthermore, on the outside of the intermediary plate a lower stopper 15 and an upper stopper 16** are attached, e.g. by means of screws.

The other elements of the kick starting means according to the present invention which are shown are located on the gear drive axle 3 and the kick starting axis 1. The inside of cover 29 (not shown in the drawings) is designed in such a way that a pinion sleeve 17, which is in alignment with the gear drive axle 3, can be connected e.g. to a support in the cover 29, e.g. by means of suitable screws. The exact location or position is ensured e.g. by two straight pins 18 in a flange **17*b* of the pinion sleeve 17 and in the cover 29**.

Furthermore, when assembled, the flange **17*b* and the cover form a space in which a clutch support plate 22 can be inserted in the gear drive axle 3. The clutch support plate 22 is preferably mounted in the cover 29 with relatively little clearance or transition fit between its side surface and a suitable surface in the cover 29. A suitable surface of a flat portion 22***a* in the cover 29 prevents the clutch support plate 22 from moving. Via a coaxial bore 22*b* in the clutch support plate 22, a clutch control lever 19 is guided whose head fits into the bore 22*b*. Moreover, the clutch control lever 19 is guided via an opposite head, which fits into a corresponding bore in the pinion sleeve 17, in such a way that it can be moved axially on the gear drive axle 3.

On the side of the clutch support plate 22 which is not shown and the side of the clutch control lever 19 which is depicted, dents 19*a* are formed into which balls 21 can be fitted and which retain the balls 21. Preferably, three dents 19*a* are provided per element. The dents 19*a* are designed in such a way that the clutch control lever 19 in a non-twisted position can assume a position which from an axial point of view is as far out as possible—i.e. in FIG. 3 as far to the front left as possible—and preferably touches the clutch support plate 22. A pressure pin 13 which is coupled with the original gear clutch (not shown in the drawing) and actuates the gear clutch, is attached axially towards the inside of the clutch control lever 19. Due to the resilience of the gear clutch, the pressure pin 13 and the clutch control lever 19 are pushed outward.

When the clutch Bowden cable (not shown in the drawing) is actuated, which can be connected a connecting rod 19*b* and an original connecting part 20 of the company Harley-Davidson, the clutch control lever 19 turns and axially moves inward. The axial movement is caused by corresponding slopes in the dents on the clutch support plate 22 and the dents 19*a* of the clutch control lever 19 as well as the balls 21 which move within them. On the cover 29 a sealed bore is provided for the clutch Bowden cable at a suitable location.

The inside of the pinion sleeve 17 furthermore comprises a bearing ring 17*a* on which a bush 12 with an externally toothed pinion 11 is positioned in such a way that is can carry out rotary and axial movements. Preferably, a pressure spring 14, which pushes the pinion 11 to the inside, is provided between the pinion 11 with the rigidly attached bush 12 and the flange 17*b* of the pinion sleeve 17. The pinion 11 can be moved axially until it reaches a ratchet nut 10, which is connected stationary with the gear drive shaft (not shown in the drawing) and is essentially fixed in the axial direction. The inside of the pinion 11 comprises a serrated surface 11*a*, which, in an engaged state, can be engaged with the serrated surface 10*a* on the outside of the ratchet nut 10 and which, during kick starting, transmits a rotary movement of the pinion 11 to the ratchet nut 10 and the gear drive shaft.

A kick starting shaft 32 runs through the cover 29 by means of a bore on the kick starting axis 1 into the inside of the cover 29, said kick starting shaft being stationary in the axial direction yet able to carry out rotary movements. The kick starting shaft 32 is sealed for example by means of an O-ring seal and arranged over a front flange sleeve 31 and a back flange sleeve 27. An inner end 32*a* of the kick starting shaft 32 is connected stationary to the externally toothed wheel 25, e.g. by means of an internal square 26*a* of a wheel 25 which is in mesh with an external square at the inner end 32*a*. The wheel 25 can be secured axially on the kick starting shaft, e.g. by means of a circlip. The kick starting axis 1 is then positioned in such a distance from the gear drive axle 3 that the wheel 25 and the externally toothed pinion 11 are in mesh.

On the inner face of the wheel 25, a disengagement means 23 and an engagement means 24 are connected stationary with the wheel, e.g. by means of screws. In a further preferred embodiment, the elements 23 and 24 or the elements 23, 24, and 26 can be formed in one piece, e.g. they can be welded together. The disengagement means 23 and the engagement means 24 comprise a disengagement area 23*a* and an engagement area 24*a*, both of which are inclined axially towards the inside and radially opposite to each other.

Furthermore, the wheel 25 preferably comprises an stop pin 26 essentially ,parallel with respect to its kick starting axle, said stop pin 26 being e.g. riveted to the wheel 25 or formed as an integral piece thereof. The stop pin 26 is supported by suitable areas of the intermediary plate and by the inside of the cover 29, in order to fix the axial position of the kick starting shaft 32 and the elements arranged on it.

The cover 29 can be attached on the intermediary plate 7 via a suitable seal 28, e.g. by means of pan head screws. Moreover, the cover 29 comprises a suitable bore with internal thread for a standard equipment oil dipstick 30 with a seal, and a bore for a waste oil screw.

A flat spiral spring 33 is located between the cover 29 and the kick starting shaft 32 which is increasingly prestressed by any rotary movement of the kick starting shaft 32. By means of a bore for the kick starting shaft 32, a spring cover 34 can be fastened on the cover 29 to cover the flat spiral spring 33, e.g. by means of a screw. At a free end 32*b* of the kick starting shaft 32 which extends outward, the above-mentioned lever (not shown in the drawings) can be positioned stationary.

All the mentioned screws are preferably inch screws, in order to be compatible with and uniform to the screws used in Harley-Davidson motorcycles.

The elements of the kick starting means of the present invention interact as follows when assembled. While at rest, the kick starting shaft 32 and the wheel 25 are prestressed via the flat spiral spring 33. A rotary movement is restricted by the disengagement means 23 in its prestressed resting position against the lower stopper 15 on the intermediary plate 7. The pinion 11, which is pushed axially through the pressure spring 14 to the inside is axially restricted by the disengagement means 23 and its disengagement area 23*a* in such a way that it is not in mesh with the ratchet nut 10 and can therefore be rotated relative to the same.

In case of a slight rotary movement of the kick starting shaft 32 and the wheel 25 of about 10° against the spring power of the flat spiral spring 33, the disengagement area 23*a* due to its inclination slowly releases the pinion 11 so that said pinion can move axially to the inside due to the strength of the pressure spring 14 until it meshes positively with the ratchet nut 10 via the serrated surfaces 11*a*, 10*a*. During this process, the constant engagement of external toothing of the wheel 25 and the pinion 11 is maintained. When the kick starting lever is pushed down quickly, the rotary movement is transmitted via the kick starting shaft 32, the wheel 25, the pinion 11 and the ratchet nut 10 to the gear drive axle for starting the engine. Shortly before the engagement means 24 reaches the upper stopper 16 and thus prevents a further rotary movement, the pinion 11 is moved axially to the outside against the spring 14 and disengages from the ratchet nut 10 by means of the engagement area 24*a* of the engagement means 24. In case the engine was started before that and thus the rotary movement of the ratchet nut 10 is faster than that of the pinion 11, the pinion is moved out of mesh against the pressure spring 14 via the serrated surface.

I claim:

1. A kick starting apparatus for a change gear connection in motorcycles, comprising:

a cover attachable to a change gear connection;

a kick starting shaft which in a mounted state extends to the inside of a cover on a kick starting axis;

a wheel attachable stationary on the kick starting shaft;

a pinion attachable on a gear drive axle in such a way that said pinion runs in mesh with the wheel;

a coupling means which transmits a rotary movement of the kick starting shaft over the wheel and the pinion to a gear drive axle during operation of the kick starting means;

wherein the kick starting axis is located above a gear shaft level formed by the gear drive axle and the gear driven axle at an angle (α) between the gear shaft level and a level of the kick starting axis and the gear drive axle of about 10° to 90°, so that an exhaust pipe assembly of the motorcycle does not interfere with the operation of the kick starting means.

2. The kick starting apparatus according to claim 1, wherein the coupling means comprises a ratchet nut having a serrated surface, a serrated surface of the pinion can be engaged with said serrated surface, and an engagement means which can be attached stationary to the kick starting axis, wherein the pinion is only connected stationary with the serrated surface of the ratchet nut via the serrated surface of the pinion during kick starting operation in such a way that a stationary movement of the kick starting shaft is transmitted to the ratchet nut.

3. The kick starting apparatus according to claim 2, wherein the coupling means comprises a pressure spring which pushes the pinion against the ratchet nut and the engagement means comprises a disengagement means and an engagement means wherein the disengagement means after the onset of the kick starting operation releases the pinion still in mesh with the wheel, so that it engages with the ratchet nut and wherein the engagement means towards the end of the kick starting operation moves the pinon out of mesh with the ratchet nut against the pressure spring.

4. The kick starting apparatus according to claim 3, wherein it comprises a pinion sleeve which can be attached on the inside of the cover and on which the pinion can be arranged such that it is movable in the axial direction.

5. The kick starting apparatus according to claim 1, wherein it comprises a clutch means attachable to the gear drive axle on the inside of the cover and actuating a change gear clutch.

6. The kick starting apparatus according to claim 5, wherein the clutch means comprises a clutch support plate stationary attachable in the cover and a clutch control lever attachable rotatably, wherein the clutch control lever is pushed against the clutch support plate, turned upon actuation of the clutch means and moved away axially from the clutch support plate by means of slopes.

7. The kick starting apparatus according to claim 6, wherein the slopes of the clutch means are formed by dents in the clutch support plate and dents in the clutch control lever, wherein balls are provided between the dents which roll into the dents on the slopes when the clutch control lever carries out a relative rotation.

8. The kick starting apparatus according to claim 1, wherein the kick starting axis is arranged above the gear shaft lever.

9. The kick starting apparatus according to claim 1, wherein the angle (α) is about 20° to 50°.

10. The kick starting apparatus according to claim 1, wherein the angle (α) is about 25° to 35°.

* * * * *